US005882584A

United States Patent [19]

Tsurukawa

[11] Patent Number: 5,882,584

[45] Date of Patent: Mar. 16, 1999

[54] INTERDENTAL BRUSH WIRE AND INTERDENTAL BRUSH

[75] Inventor: Naoki Tsurukawa, Osaka, Japan

[73] Assignee: Sunstar, Inc., Osaka, Japan

[21] Appl. No.: 835,193

[22] Filed: Apr. 7, 1997

[30] Foreign Application Priority Data

Apr. 9, 1996 [JP] Japan ..... 0886135
Nov. 22, 1996 [JP] Japan ..... 08311847

[51] Int. Cl.[6] ..... C22C 38/38; C22C 38/22; C22C 38/44

[52] U.S. Cl. ..... 420/159; 420/43; 420/65; 428/606

[58] Field of Search ..... 420/59, 43, 65; 148/597; 428/597, 606

[56] References Cited

U.S. PATENT DOCUMENTS 3,311,511 3/1967 Goller ..... 148/597
3,989,474 11/1976 Goller et al. ..... 420/59
5,716,466 2/1998 Yamaoka et al. ..... 148/597

FOREIGN PATENT DOCUMENTS 61-130459 6/1986 Japan ..... 148/597

*Primary Examiner*—Deborah Yee

[57] ABSTRACT

An interdental brush wire and an interdental brush which are not buckled or broken, are excellent in durability and manipulation ease due to the springy brush as well as the ability of insertion between teeth characterized in that the wire is a stainless steel wire having a diameter of 0.15 to 0.35 mm and containing nitrogen and a controlled amount of manganese.

12 Claims, 5 Drawing Sheets

INTERDENTAL BRUSH WIRE AND INTERDENTAL BRUSH

BACKGROUND OF THE INVENTION

1. Field of the Invention

The present invention relates to an interdental brush wire and an interdental brush which are excellent in durability and manipulation ease as well as ability of insertion between teeth.

2. Description of the Related Art

An interdental brush is mainly composed of a brush and a handle for supporting this brush. The brush is produced by folding a single wire at an intermediate portion, sandwiching bundles of filaments between folded portions of the wire and twisting the wire. As the wire is frequently used a stainless steel wire having a diameter of 0.25 to 0.35 mm, particularly, a JIS (Japanese Industrial Standard) SUS304 stainless steel wire.

The interdental brush is used to remove plaque and tartar which accumulate between teeth by pushing and pulling the brush inserted between teeth. Therefore, the wire must be thin enough to be inserted between teeth and hard not to be buckled by this push-pull operation. Also, since the interdental brush is positioned between teeth by bending the base of the brush, it must be durable not to be broken by this bending operation.

Since the interdental brush of the prior art is not sufficiently hard, a buckling phenomenon that the wire is easily bent like a letter S easily occurs. Further, when the base of the brush is bent repeatedly, it may be broken while it is in use due to insufficient durability. To improve the ability of insertion between teeth, a thin wire must be used. However, when the diameter of the wire is reduced, the above buckling phenomenon and break phenomena will become more serious.

The inventor of the present invention has conducted investigations on the requirements of an interdental brush wire and confirmed that the following conditions are required for the interdental brush wire.

(1) The wire must be chemically nontoxic to human body.

(2) The wire must not be sprung back and can be twisted.

(3) The wire must not be broken even when it is bent repeatedly.

(4) The wire must not be buckled by a brushing operation along the axial direction of the wire.

An interdental brush which satisfies the above requirements is proposed in Japanese Unexamined Patent Publication No. 317123 of 1993. The present invention discloses a wire which has a large flexural strength, that is, a wire having a large Young's modulus to improve the effect of preventing the buckling and break of the wire and is coated with a low-melting thermoplastic resin which is fused and solidificated after twisting to prevent a spring-back phenomenon.

According to the present invention, it is possible to improve the tensile strength and buckling strength of the wire while the wire is twisted as in the prior art because twisting can prevent the spring-back phenomenon of the wire. However, the technique of the present invention involves such problems that the number of production steps increases because resin coating to the wire and fusion and solidification of the coated resin are required and that the ability of insertion between teeth deteriorates because of a substantial increase in the diameter of the wire due to the presence of the coated resin.

As disclosed in Japanese Unexamined Patent Publication No. 227315 of 1995 (Registration No.2538533), an interdental brush which satisfies the above requirements and uses a cobalt-based alloy wire without coating a resin on the wire has been proposed. However, in the present invention, to improve the tensile strength and buckling strength of the wire, the wire must contain expensive cobalt in an amount of 30 to 60 wt %, resulting in an increase in the material costs of the wire, thereby boosting the production costs of the interdental brush.

SUMMARY OF THE INVENTION

In view of the above circumstances, the present invention has been made, and therefore, it is an object of the present invention to provide an interdental brush wire and an interdental brush which are not buckled or broken, have excellent durability and manipulation ease owing to a resilient brush and are excellent in the ability of insertion between teeth.

The present invention is intended to solve the above problems by using an inexpensive material which is the most suitable for use as an interdental brush wire. Basically, the mechanical properties such as Young's modulus, proof stress and tensile strength of an interdental brush wire are improved by adding nitrogen to stainless steel, particularly conventionally used SUS304-based stainless steel, and controlling the proportion of manganese.

The wires of the present invention are divided into a first group of wires defined in a first aspect to a seventh aspect of the present invention and a second group of wires defined in an eighth aspect to an eleventh aspect of the present invention according to the content of manganese. The first group of wires defined in the first to seventh aspects of the present invention has a manganese content of more than 2.50 wt % and the second group of wires defined in the eighth to eleventh aspects has a manganese content of less than 2.50 wt %.

According to the first aspect of the present invention, there is provided an interdental brush wire which comprises a stainless steel wire having a diameter of 0.15 to 0.35 mm as and containing at least iron, chromium, manganese and nitrogen in the chemical composition, wherein a manganese content is not less than 2.50 wt % and a nitrogen content is not less than 0.10 wt %.

An interdental brush wire defined in the second aspect of the present invention, which is common to the first aspect of the present invention in wire diameter and essential elements and specifies the proportion of each element, comprises a stainless steel wire having a diameter of 0.15 to 0.35 mm and containing at least iron, chromium, manganese and nitrogen in the chemical composition, wherein a chromium content is 12 to 32 wt %, a manganese content is 10 to 38 wt %, and a nitrogen content is not less than 0.10 wt %.

An interdental brush wire defined in the third aspect of the present invention, which further limits the preferred range of the proportion of each element based on the constitution defined in the second aspect of the present invention, comprises an austenite stainless steel wire having a diameter of 0.15 to 0.35 mm and containing at least iron, chromium, manganese and nitrogen in the chemical composition, wherein a chromium content is 17 to 19 wt %, a manganese content is 17 to 19 wt % and a nitrogen content is not less than 0.65 wt %.

According to the fourth aspect of the present invention, based on the constitution defined in the first aspect of the present invention, there is provided an interdental brush wire further containing molybdenum and nickel.

An interdental brush wire defined in the fourth aspect of the present invention comprises a stainless steel wire having a diameter of 0.15 to 0.35 mm and containing at least iron, chromium, manganese, molybdenum, nickel and nitrogen in the chemical composition, wherein a manganese content is not less than 2.50 wt % and a nitrogen content is not less than 0.10 wt %.

According to the fifth aspect of the present invention, based on the constitution defined in the fourth aspect of the present invention, there is provided an interdental brush, which comprises a stainless steel wire having a diameter of 0.15 to 0.35 mm and containing at least iron, chromium, manganese, molybdenum, nickel and nitrogen in the chemical composition, wherein a chromium content is 12 to 32 wt %, a manganese content is 10 to 38 wt %, a nickel content is not more than 6 wt %, a molybdenum content is not more than 7 wt % and a nitrogen content is not less than 0.10 wt %.

According to the sixth aspect of the present invention, based on the constitution defined in the fourth aspect of the present invention, there is provided an interdental brush wire which comprises an austenite stainless steel wire having a diameter of 0.15 to 0.35 mm and containing at least iron, chromium, manganese, molybdenum, nickel and nitrogen in the chemical composition, wherein a chromium content is 17 to 19 wt %, a manganese content is 17 to 19 wt %, a nickel content is less than 1.0 wt %, a molybdenum content is 1.5 to 2.5 wt % and a nitrogen content is not less than 0.65 wt %.

According to the seventh aspect of the present invention, based on the constitution defined in the fourth aspect of the present invention, there is provided an interdental brush wire which comprises an austenite stainless steel wire having a diameter of 0.15 to 0.35 mm and containing at least carbon in an amount of not more than 0.08 wt %, silicon in an amount of not more than 1.00 wt %, manganese in an amount of 17.00 to 19.00 wt %, phosphorus in an amount of not more than 0.045 wt %, sulfur in an amount of not more than 0.030 wt %, nickel in an amount of not more than 1.0 wt %, chromium in an amount of 17.00 to 19.00 wt %, molybdenum in an amount of 1.5 to 2.5 wt % and nitrogen in an amount of not less than 0.65 wt % in the chemical composition.

According to the eighth aspect of the present invention, there is provided an interdental brush wire which comprises an austenite stainless steel wire having a diameter of 0.15 to 0.35 mm and containing carbon in an amount of not more than 0.08 wt %, silicon in an amount of not more than 1.00 wt %, manganese in an amount of not more than 2.50 wt %, phosphorus in an amount of not more than 0.045 wt %, sulfur in an amount of not more than 0.030 wt %, nickel in an amount of 7.00 to 10.50 wt %, chromium in an amount of 18.00 to 20.00 wt % and nitrogen in an amount of 0.10 to 0.25 wt % in the chemical composition.

An interdental brush wire defined in the ninth aspect of the present invention specifies the type of steel available on the market according to the eighth aspect of the present invention. According to the ninth aspect of the present invention, there is provided an interdental brush wire which comprises: a wire having a diameter of 0.15 to 0.35 mm; and a material defined by SUS304N1 stainless steel wire made from a JIS G4303 stainless steel bar.

An interdental brush wire defined in the tenth aspect of the present invention is the same as one defined in the first to eighth aspects of the present invention in that SUS304-based stainless steel contains nitrogen, and the proportion of manganese is controlled but is different in composition.

According to the tenth aspect of the present invention, there is provided an interdental brush wire which comprises an austenite stainless steel wire having a diameter of 0.15 to 0.35 mm and containing at least carbon in an amount of not more than 0.08 wt %, silicon in an amount of not more than 1.00 wt %, manganese in an amount of not more than 2.50 wt %, phosphorus in an amount of not more than 0.045 wt %, sulfur in an amount of not more than 0.030 wt %, nickel in an amount of 7.50 to 10.50 wt %, chromium in an amount of 18.00 to 20.00 wt %, nitrogen in an amount of 0.15 to 0.30 wt % and niobium in an amount of not more than 0.15 wt % in the chemical composition.

An interdental brush wire defined in the eleventh aspect of the present invention specifies the type of steel available on the market according to the tenth aspect of the present invention. According to the eleventh aspect of the present invention, there is provided an interdental brush wire which comprises: a wire having a diameter of 0.15 to 0.35 mm; and a material defined in SUS304N2 steel wire made from a JIS G4303 stainless steel bar.

According to a twelfth aspect of the present invention, based on the composition defined in the first to eleventh aspects of the present invention, there is provided an interdental brush wire having such wire tensile properties as a proof stress of not less than 40 kgf/mm$^2$ and an elongation of not less than 30% before twisting.

According to a thirteenth aspect of the present invention, based on the composition defined in any one of the first to eleventh aspects of the present invention and the mechanical properties defined in the twelfth aspect of the present invention, there is provided an interdental brush wire having such wire tensile properties as a Young's modulus of not less than 12,000 kgf/mm$^2$ before twisting According to a fourteenth aspect of the present invention, there is provided an interdental brush prepared by twisting the interdental brush wire defined in the first to thirteenth aspects of the present invention, sandwiching and fixing bundles of filaments between the twisted wires.

The interdental brush wire and interdental brush according to the present invention have high mechanical properties of the wire such as Young's modulus, proof stress and tensile strength and are well balanced in terms of hardness, spring properties and workability which are required for an interdental brush wire since nitrogen is added to stainless steel, particularly SUS304-based stainless steel and the proportion of manganese is controlled. In addition, it is possible to reduce the diameter of the wire while maintaining characteristic features as a wire material of an interdental brush.

Further, an interdental brush wire which contains molybdenum has improved corrosion resistance.

BRIEF DESCRIPTION OF THE DRAWINGS

These and other objects and advantages of the present invention will become clear by the following description of preferred embodiments of the present invention with reference to the accompanying drawings, wherein.

DETAILED DESCRIPTION OF THE PREFERRED EMBODIMENTS

The present invention is described in detail hereinunder with reference to preferred embodiments.

Figure 1A:
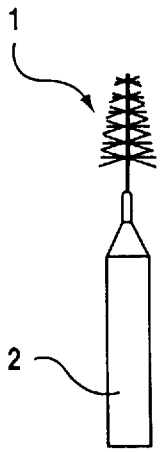
FIGS. 1A and 1B are front views of an interdental brush according to the present invention.
Figure 1B:
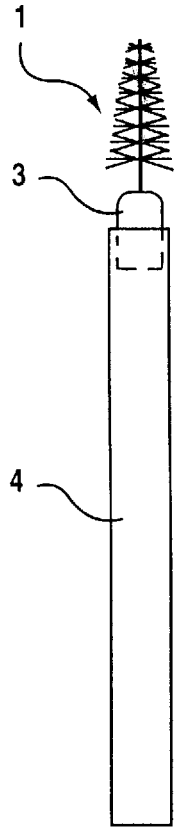

FIG. 1 shows an example of an interdental brush which the present invention is directed to. Interdental brushes include a throwaway type one in which a brush 1 is buried and fixed in a short handle 2 as shown in FIG. 1A, one in which a brush 1 buried and fixed in a short base 3 is attached to a long holder 4 detachably as shown in FIG. 1B, one, not shown, in which an end portion of a long holder 4 is bent, and one in which a brush and a handle are separated and the brush is attached to the handle upon use. The present invention can be applied to all of the interdental brushes.

Figure 2A:
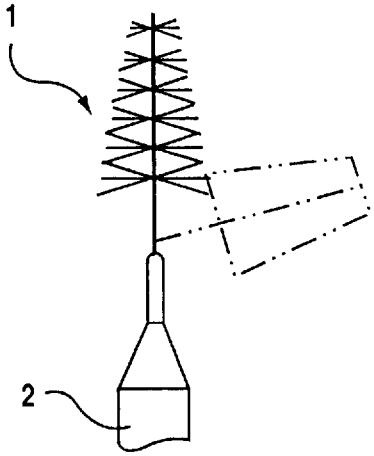
FIGS. 2A and 2B are diagrams for explaining external force applied to the brush while it is in use.
Figure 2B:
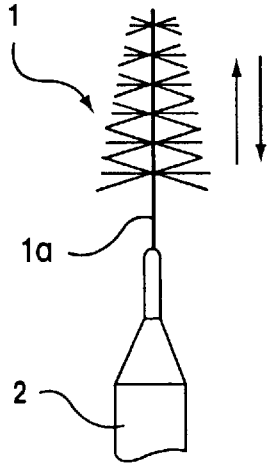

To position an interdental brush between teeth, a bending operation of the brush 1 is repeated with a base portion of the brush as a fulcrum as shown in FIG. 2A and a brushing operation, that is, pushing and pulling of the brush 1 along the axis of the wire 1*a* is repeated as shown in FIG. 2B. The present invention is aimed to prevent the wire 1*a* from being broken or buckled by these operations.

Figure 3:
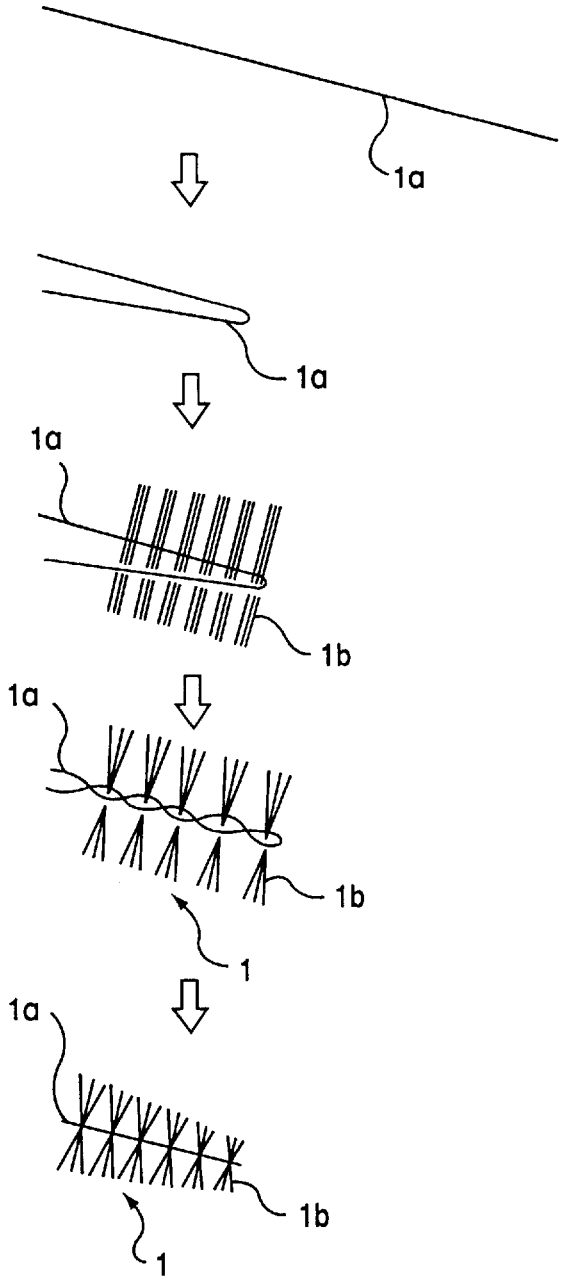
FIG. 3 is a diagram for explaining the procedure of twisting.

FIG. 3 shows schematically the production process of the brush. The process comprises bending a single wire 1*a* at an intermediate portion, sandwiching bundles of filaments 1*b* between folded portions of the wire 1*a*, twisting the wire 1*a* and trimming the hairs. This process is the same as in the prior art and the present invention. The present invention is also aimed to provide workability that makes possible the above twisting and can keep form without a spring-back after twisting, that is, appropriate plastic deformation.

It is important to make the brush 1 thin in order to improve the ability of insertion between teeth. In the present invention, the thickness of each wire is set to the range of 0.15 to 0.35 mm which is thinner than a generally used range of 0.25 to 0.35 mm. To ensure that such a thin wire can exhibit sufficient durability to be used as an interdental brush, the chemical composition is adjusted. To clean the space narrower than the present state, the thickness of the wire is preferably set to the range of 0.15 to 0.25 mm. Further, in consideration of the balance between the brush s difficulty of being bent and ability of insertion, the thickness of the wire is preferably set to the range of 0.20 to 0.25 mm when importance is attached to the difficulty of being bent.

A wire having special chemical composition is used to make possible twisting and ensure that the wire is not broken or buckled even when such a thin wire is used.

Wires used in the present invention are produced by adding nitrogen to a stainless steel wire, particularly a JIS SUS304-based stainless steel wire as a base and adjusting the amount of manganese to be added and are divided into two groups according to whether or not the content of manganese is more than 2.50 wt %.

First group: a group of wires having a manganese content of more than 2.50 wt %

Second groups: a group of wires having a manganese content of less than 2.50 wt %

Wires having a manganese content of 2.50 wt % can be considered to belong to any one of the groups.

A description is first given of the first group of wires.

The starting material of the first group of wires is preferably a stainless steel-based alloy containing at least iron, chromium, manganese and nitrogen in the chemical composition and has a manganese content of not less than 2.50 wt % and a nitrogen content of not less than 0.10 wt %.

Based on the above composition, the alloy more preferably has a chromium content of 12 to 32 wt %, a manganese content of 10 to 38 wt % and a nitrogen content of not less than 0.10 wt %. Stated more specifically, an austenite stainless steel-based alloy having a chromium content of 17 to 19 wt %, a manganese content of 17 to 19 wt % and a nitrogen content of not less than 0.65 wt% can be used.

Further, alloys prepared by adding molybdenum and nickel to the alloys having the above compositions may be used. The addition of molybdenum contributes to the improvement of corrosion resistance. As for the composition of an alloy containing molybdenum and nickel, the wire is preferably a stainless steel wire containing at least iron chromium, manganese, molybdenum, nickel and nitrogen and having a manganese content of not less than 2.50 wt % and a nitrogen content of not less than 0.10 wt %.

Based on the above composition, the alloy is more preferably a stainless steel-based alloy having a chromium content of 12 to 32 wt %, a manganese content of 10 to 38 wt %, a nickel content of not more than 6 wt %, a molybdenum content of not more than 7 wt % and a nitrogen content of not less than 0.10 wt %. Stated more specifically, an austenite stainless steel-based alloy having a chromium content of 17 to 19 wt %, a manganese content of 17 to 19 wt %, a nickel content of less than 1.0 wt %, a molybdenum content of 1.5 to 2.5 wt % and a nitrogen content of not less than 0.65 wt % can be used.

As for the more specific composition of the alloy, the alloy is an austenite stainless steel-based alloy having at least a carbon content of not more than 0.08 wt %, a silicon content of not more than 1.00 wt %, a manganese content of 17.00 to 19.00 wt %, a phosphorus content of not more than 0.045 wt %, a sulfur content of not more than 0.030 wt %, a nickel content of not more than 1.0 wt %, a chromium content of 17.00 to 19.00 wt %, a molybdenum content of 1.5 to 2.5 wt % and a nitrogen content of not less than 0.65 wt %.

The wires of the second group include an austenite stainless steel wire having a carbon content of not more than 0.08 wt %, a silicon content of not more than 1.00 wt %, a manganese content of not more than 2.50 wt %, a phosphorus content of not more than 0.045 wt %, a sulfur content of not more than 0.030 wt %, a nickel content of 7.00 to 10.50 wt %, a chromium content of 18.00 to 20.00 wt % and a nitrogen content of 0.10 to 0.25 wt % or an austenite stainless steel wire having a carbon content of not more than 0.08 wt %, a silicon content of not more than 1.00 wt %, a manganese content of not more than 2.50 wt %, a phosphorus content of not more than 0.045 wt %, a sulfur content of not more than 0.030 wt %, a nickel content of 7.50 to 10.50 wt %, a chromium content of 18.00 to 20.00 wt %, a nitrogen content of 0.15 to 0.30 wt % and a niobium content of not more than 0.15 wt %. The niobium is preferably contained in an amount of 0.08±0.02%.

The former chemical composition is the same as one known as SUS304N1 of a JIS G 4303 stainless steel bar and the latter chemical composition is the same as one known as SUS304N2 of a JIS G 4303 stainless steel bar. Table 1 shows the chemical compositions of SUS304N1 and SUS304N2. One of the products of the former wire is SUS304ES of Riken Electric Wire Co. and one of the products of the latter wire is SUS304HN of Riken Electric Wire Co.

Wires of the first group and the second group have the following characteristics in mechanical properties such as proof stress, Young's modulus and elongation.

The proof stress indicates stress at the time when an extremely small permanent set of 0.2% is produced and is related to strength for keeping form against external force for deforming a wire.

The elongation indicates how much the starting material stretches before it is broken and is related to plastic deformation.

Young's modulus to not less than 15,000 kgf/mm$^2$. By satisfying such mechanical requirements, an interdental brush wire can achieve required hardness, spring properties and workability all of which are well balanced.

To define the feature of the wire of the first group in terms of composition, Table 1 shows an example of the alloy composition of the wire of the first group and comparison between the chemical composition and the compositions of SUS304 conventionally known as an interdental brush wire and the composition of NAS604PH which is a cobalt-based alloy used in Japanese Unexamined Patent Publication No. 227315 of 1995(Registration No. 2538533) described as the prior art. Table 1 also shows the compositions of the chemical elements of SUS304N1 and SUS304N2 of the second group. In Table 1, the alloy of the example of the first group is expressed as "new alloy". This new alloy corresponds to the description of the seventh aspect of the present invention.

TABLE 1

| | | Standard values of chemical compositions of new alloy of first group, and cobalt-based alloy other austenite stainless steels (wt %) | | | | | | | | | | |
|---|---|---|---|---|---|---|---|---|---|---|---|---|
| Type of metal wire/composition | | C | P | Si | Mn | S | Ni | Cr | Mo | N | Others | Fe |
| Examples | Standard values of new alloy of first group | <0.08 | <0.045 | <1.00 | 17 to 19 | <0.030 | <1.0 | 17–19 | 1.5 to 2.5 | >0.65 | — | remainder |
| | Standard values of SUS304HN (SUS304N2) | ≦0.08 | ≦0.045 | ≦1.00 | ≦2.50 | ≦0.030 | 7.50 to 10.50 | 18.00 to 20.00 | — | 0.15 to 0.30 | Nb ≦ 0.15 | remainder |
| | Standard values of SUS304ES (SUS304N1) | ≦0.08 | ≦0.045 | ≦1.00 | ≦2.50 | ≦0.030 | 7.00 to 10.50 | 18.00 to 20.00 | — | 0.10 to 0.25 | — | remainder |
| Comparative Examples | Standard values of NAS604PH | 0.10 to 0.15 | ≦0.030 | ≦0.50 | 0.90 to 1.5 | ≦0.015 | 15.50 to 17.50 | 20.50 to 22.50 | 5.80 to 0.80 | — | Co 40% or more | remainder |
| | Standard values of SUS304 | ≦0.08 | ≦0.045 | ≦1.00 | ≦2.00 | ≦0.030 | 8.00 to 10.50 | 18.00 to 20.00 | — | — | — | remainder |

The Young's modulus indicates the difficulty of being distorted and is related to the difficulty of being deformed and hardness.

According to the study conducted by the inventor, an interdental brush wire preferably has both larger proof stress and elongation. If the elongation is small even when the proof stress is large, it is difficult to twist a wire due to poor plastic deformation properties though it has great capability of preventing deformation to keep the present form against deformation force. The Young's modulus needs to be large so that the wire is not buckled when it is in use.

As for the tensile characteristics of the wire material, the proof stress is adjusted to not less than 40 kgf/MM$^2$ and the elongation is adjusted to not less than 30%. By satisfying these mechanical requirements, an interdental brush wire can achieve required spring properties and workability. Further, appropriate hardness can be obtained by providing an Young's modulus of not less than 12,000 kgf/mm$^2$.

More preferably, the proof stress is adjusted to not less than 60 kgf/mm$^2$, the elongation to not less than 40% and the The interdental brush wire of the present invention is characterized in that it contains more manganese and nitrogen than NAS604PH, SUS304, SUS304N1 and SUS304N2. The new alloy (corresponds to the seventh aspect of the present invention) shown in Table 1 contains a small amount of nickel. SUS304, SUS304N1 and SUS304N2 do not contain molybdenum whereas the new alloy (corresponds to the seventh aspect of the present invention) and NAS604PH contain molybdenum. This new alloy has improved corrosion resistance because it contains a small amount of molybdenum.

A description is subsequently given of various tests which have been conducted to confirm the effects of the present invention.

Stainless steel wires having chemical compositions shown in Table 2 were measured for their mechanical properties and evaluated for their performance as a brush.

Figure 8:
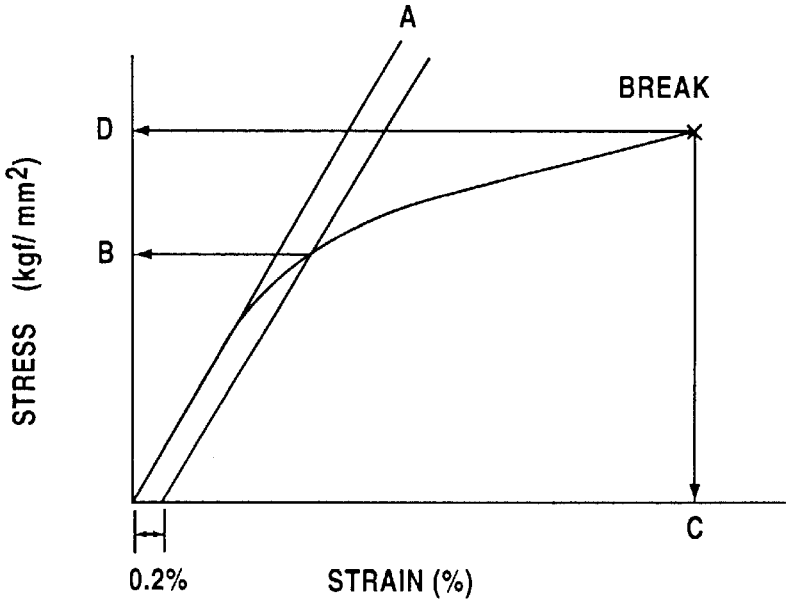
FIG. 8 is a graph showing a stress-strain curve for explaining proof stress, elongation, tensile strength, and Young's modulus.

The mechanical properties were measured as follows. A test sample was fixed between 100 mm apart folded portions of a holding tool and this test sample having a substantial length of 100 mm was pulled at a speed of 30 mm/min to obtain a stress-strain curve as shown in FIG. 8. The Young's modulus is obtained from the inclination of a straight line A representing the gradient of a rising portion of the curve from a starting point in the figure. The proof stress is obtained from a value B, the elongation from a value C and the tensile strength from a value D in the figure. The measurement results are shown in Table 3 and the evaluation results are shown in Table 4. The thickness of the steel wire used is 0.25 mm in diameter. A fatigue test under constant strain and a vibrating fatigue test were conducted as follows and the buckling strength was measured by the following method. It can be judged that the greater the values the more excellent the interdental brush wire is. The number of samples is 5 and average values are given in the tables.

(fatigue test under constant strain)

Figure 6A:
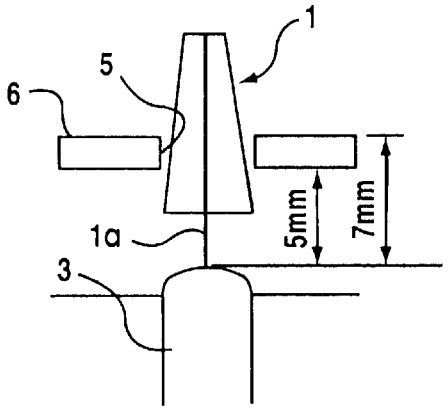
FIGS. 6A and 6B are diagrams for a low-speed test in a vibrating fatigue test.
Figure 6B:
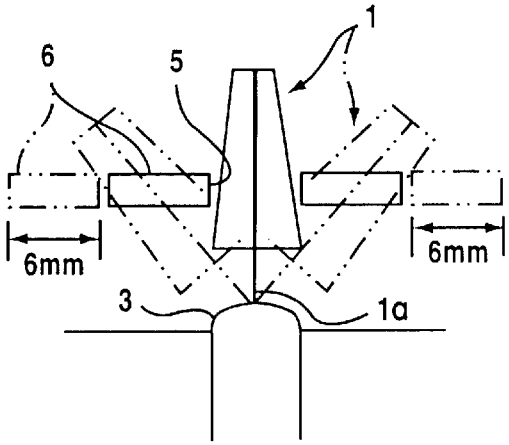

A slide plate 6 having a 2 mm-diameter through hole 5 5 mm above the base portion of the wire is placed horizontally and moved in right and left directions alternately from the original position by 6 mm each while an end portion of the brush 1 is fit in the through hole 5 as shown in FIG. 6B. The end portion of the brush 1 is vibrated at an amplitude of 12 mm and a frequency of 60 rpm and the number of movements is counted until the wire 1*a* is broken.

(buckling strength test)

Figure 7A:
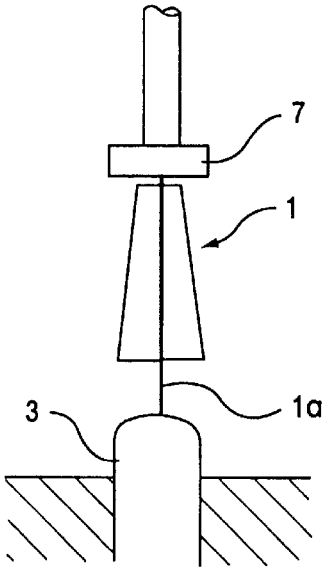
FIGS. 7A and 7B are diagrams for explaining a buckling strength test.
Figure 7B:
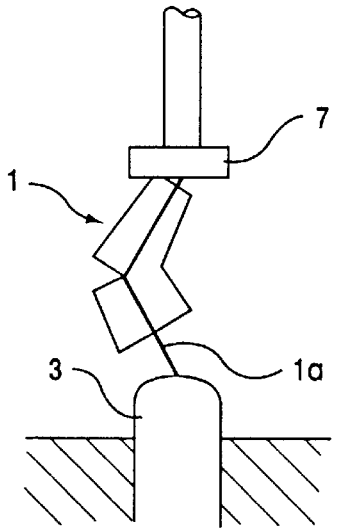

As shown in FIG. 7A, a pressure plate 7 is applied to a tip of an interdental brush wire and the pressure force applied to the pressure plate 7 increases gradually (pressure plate moved down 10 mm/min). The load is measured when the wire buckles as shown in FIG. 7B.

TABLE 2

Measurement values of chemical compositions of new alloy of first group, other austenite stainless steel wires, and cobalt-based alloy

| Type of metal wire/composition | | C | P | Si | Mn | S | Ni | Cr | Mo | N | Others | Fe |
|---|---|---|---|---|---|---|---|---|---|---|---|---|
| Examples | Measurement values of new alloy group | 0.032 | 0.015 | 0.67 | 18.24 | 0.005 | 0.52 | 17.81 | 2.02 | 0.76 | — | remainder |
| | Measurement values of SUS304HN (SUS304N2) | 0.050 | 0.034 | 0.75 | 1.75 | 0.001 | 8.22 | 18.35 | — | 0.21 | Nb: 0.08 | remainder |
| | Measurement values of SUS304ES (SUS304N1) | 0.070 | 0.012 | 0.78 | 0.34 | 0.000 | 8.33 | 19.64 | — | 0.19 | | remainder |
| Comparative Examples | Measurement values of NAS604PH | 0.13 | 0.005 | 0.38 | 1.13 | 0.005 | 16.49 | 21.41 | 6.07 | — | Co 40.85 | remainder |
| | Measurement values of SUS304 | 0.070 | 0.027 | 0.35 | 1.27 | 0.008 | 8.61 | 18.13 | — | — | — | remainder |

Figure 4A:
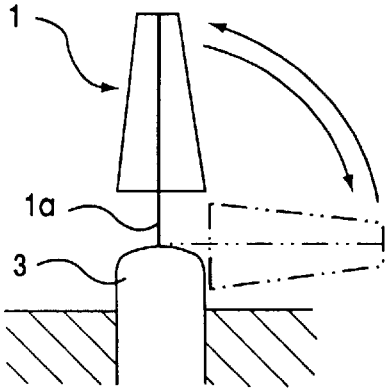
FIGS. 4A and 4B are diagrams for explaining a fatigue test under constant strain.
Figure 4B:
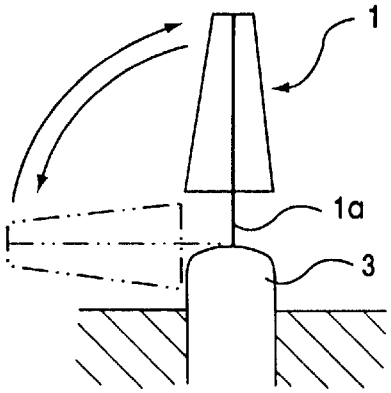

As shown in FIG. 4A, an interdental brush wire 1*a* is bent at 90° at a position near a base portion thereof and then returned to the original position. Thereafter, as shown in FIG. 4B, it is bent at 90° in an opposite direction and then returned to the original position. This reciprocating movement is counted two and the number of bending operations is counted until the wire 1*a* is broken.

(vibrating fatigue test)

Both a high-speed test and a low-speed test were conducted.

(1) high-speed test

Figure 5A:
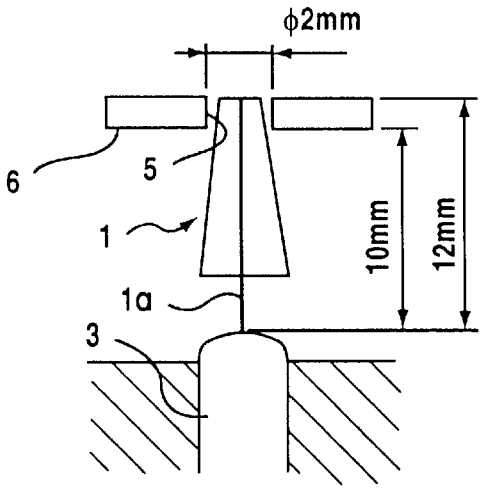
FIGS. 5A and 5B are diagrams for explaining a high-speed test in a vibrating fatigue test.
Figure 5B:
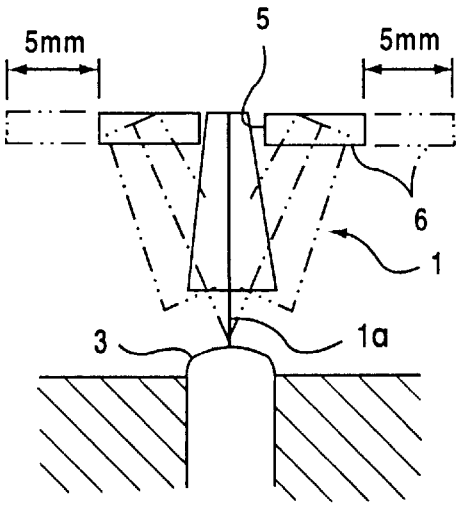

As shown in FIG. 5A, a brush 1 having a length from a base portion to an end portion of a wire 1*a* of 12 mm is used. A slide plate 6 having a 2 mm-diameter through hole 5 10 mm above the base portion of the wire is placed horizontally and moved in right and left directions alternately from the original position by 5 mm each while an end portion of the brush 1 is fit in the through hole 5 as shown in FIG. 5B. The end portion of the brush 1 is vibrated at an amplitude of 10 mm and a frequency of 300 rpm and the number of movements is counted until the wire 1*a* is broken.

(2) low-speed test

As shown in FIG. 6A, a brush 1 having a length from a base portion to an end portion of a wire 1*a* of 12 mm is used.

TABLE 3

Mechanical properties of wires which were annealed (tensile property).

| | | Young's modulus (kgf/mn$^2$) | Proof stress (kgf/mn$^2$) | Elongation % | Tensile strength (kgf/mn$^2$) |
|---|---|---|---|---|---|
| Example | New alloy of first group | 16000 | 93.2 | 50.5 | 112.2 |
| | SUS304HN (SUS304N2) | 15900 | 84.1 | 33.4 | 111.7 |
| | SUS304ES (SUS304N1) | 14000 | 55.5 | 47.2 | 91.6 |
| Comparative | NAS605PH | 17600 | 57.3 | 59.3 | 108.6 |
| Example | SUS304 | 12900 | 34.9 | 53.0 | 76.4 |

TABLE 4

| | | Evaluation results of performance | | | |
|---|---|---|---|---|---|
| | | | | Vibrating fatigue test | |
| | | Buckling strength (g) | Fatigue test under constant strain (stroke) | High-speed Speed: 300 rpm Width: 10 mm Height: 10 mm | Low-speed Speed: 60 rpm Width: 12 mm Height: 5 mm |
| Example | New alloy of first group | 402.4 | 12.8 | 4810 | 93.0 |
| | SUS304HN (SUS304N2) | 385.6 | 14.6 | 2253 | 56.6 |
| | SUS304ES (SUS304N1) | 330.0 | 12.4 | 1655 | 54.8 |
| Comparative Example | NAS604PH | 435.7 | 11.5 | 4087 | 81.7 |
| | SUS304 | 286.8 | 8.6 | 1110 | 53.0 |

The following points are understood from Tables 3 and 4.

It is evident that the interdental brush using the wire of the above example of the first group has greater values than interdental brushes using SUS304, SUS304N2 and SUS304N1 in all the items except the result of the fatigue test under constant strain and is superior in mechanical strengths. The value of proof stress of the interdental brush is worthy of special mention and is greater than that of an interdental brush using expensive NAS604PH. The proof stress is extremely important for interdental brush wires. Therefore, it can be said that the wire of the present invention having great proof stress is the most suitable as an interdental brush wire. Incidentally, since the wire of the present invention has great proof stress, it must be twisted through plastic deformation at a lower speed than a conventional austenite stainless steel wire so as to prevent a spring-back phenomenon. By twisting at a lower speed than the conventional austenite stainless steel wire, an interdental brush having excellent durability and free from a spring-back phenomenon can be obtained.

Further, although interdental brushes using SUS304HN (SUS304N2) and SUS304ES (SUS304N1) are inferior to the interdental brush of the above example of the first group in mechanical properties, they are superior to the existing interdental brush using SUS304 in all of Young's modulus, proof stress and tensile strength. For example, compared with the existing interdental brush using SUS304, the interdental brush using SUS304HN is improved by about 34.6% and that using SUS304ES by about 15.4% in buckling strength, the interdental brush using SUS304HN is improved by about 69.8% and that using SUS304ES by about 44.2% in the fatigue test under constant strain, the interdental brush using SUS304HN is improved by about 2.03 times and that using SUS304ES by about 1.49 times in the high-speed test of the vibrating fatigue test, and the interdental brush using SUS304HN is improved by about 6.8% and that using SUS304ES by about 3.4% in the low-speed test of the vibrating fatigue test. Both of the interdental brushes were rated high in all the buckling strength, fatigue test under constant strain and vibrating fatigue test.

Next, the present inventor has conducted the evaluation of the actual use of the wire of the above example (defined in the seventh aspect of the present invention) and the conventional SUS304 wire on 14 users. The evaluation items total 11 consisting of presence or absence of resilient force of each wire, like or dislike of resilient force of each wire, difficulty of bending each wire, how many days elapsed before each wire is bent, breakage of each wire, durability of each wire, ability of insertion between teeth, touch of each wire with teeth and gum, cleaning effect, filament removal and overall evaluation. The results shown in Table 5 were obtained when the respective wires were used every morning and night reciprocally for 1 week. The results are expressed as average values and the figures within the parentheses show standard deviations.

TABLE 5

| Evaluation of actual use of interdental brush using new alloy wire of the present invention and existing interdental brush using SUS304 (14 brushes of each type were used for 1 week) | | | |
|---|---|---|---|
| Evaluation item | Evaluation point | Interdent brush using new alloy wire of the present invention average value (standard deviation) | Interdent brush using SUS304 wire average value (standard deviation) |
| Resilient force of wire | 2: high<br>1: slightly high<br>0: medium<br>−1: slightly low<br>−2: low | 0.64 (0.50) | −1.21 (0.80) |
| Like or dislike of resilient force of wire | 2: like<br>1: like a little<br>0: medium<br>−1: dislike a little<br>−2: dislike | 0.64 (0.74) | −1.21 (0.89) |

TABLE 5-continued

Evaluation of actual use of interdental brush using new alloy wire of the present invention and existing interdental brush using SUS304 (14 brushes of each type were used for 1 week)

| Evaluation item | Evaluation point | Interdent brush using new alloy wire of the present invention average value (standard deviation) | Interdent brush using SUS304 wire average value (standard deviation) |
|---|---|---|---|
| Bending of wire | 2: hard to be bent<br>1: slightly hard to be bent<br>0: medium<br>−1: slightly<br>−2: easy to be bent | 0.50 (0.76) | −1.29 (0.73) |
| Number of days elapsed before it is bent | | 6.71 (1.90) | 3.36 (2.71) |
| Breakage of wire | 2: hard to be broken<br>1: slightly hard to be broken<br>0: medium<br>−1: slightly easy to be broken<br>−2: easy to be broken | 0.79 (0.80) | −0.36 (1.28) |
| Durability of wire | 2: good<br>1: slightly good<br>0: medium<br>1: slightly bad<br>2: bad | 0.71 (0.73) | −1.07 (0.83) |
| Ability of insertion between teeth | 2: easy to insert<br>1: slightly easy to insert<br>0: medium<br>−1: slightly difficult to insert<br>−2: difficult to insert | 0.64 (0.84) | −0.71 (0.83) |
| Touch with tooth and gum | 2: good<br>1: slightly good<br>0: medium<br>−1: slightly bad<br>−2: bad | 0.36 (0.74) | 0.00 (0.78) |
| Cleaning effect | 2: feel that teeth are well cleaned<br>1: feel that teeth are cleaned<br>0: medium<br>−1: feel that teeth are not so well cleaned<br>−2: feel that teeth are not cleaned | 1.07 (0.62) | 0.29 (0.83) |
| Filament removal | 2: hard to be removed<br>1: slightly hard to be removed<br>0: medium<br>−1: slightly easy to be removed<br>−2: easy to be removed | 0.64 (0.84) | 0.50 (0.94) |
| Overall evaluation | 2: the brush of the present invention is better<br>1: the brush of the present invention is slightly better<br>0: the brushes of the present invention and the brush using SUS304 are the same | 1.43 (0.85) | |

TABLE 5-continued

| Evaluation of actual use of interdental brush using new alloy wire of the present invention and existing interdental brush using SUS304 (14 brushes of each type were used for 1 week) | | | |
|---|---|---|---|
| Evaluation item | Evaluation point | Interdent brush using new alloy wire of the present invention average value (standard deviation) | Interdent brush using SUS304 wire average value (standard deviation) |
| | −1: the brush using SUS304 is slightly better<br>−2: the brush using SUS304 is better | | |

As shown in Table 5, the interdental brush using the wire of the present invention was rated higher than the existing interdental brush using SUS304 in all the items.

The inventor has conducted the evaluation of the actual use of the interdental brush of the above example (defined in the seventh aspect of the present invention), an interdental brush using NAS604PH and the existing interdental brush using SUS304N2 on 11 users. The evaluation items total 8 consisting of resilient force of each wire, like or dislike of resilient force of each wire, bending of each wire, ability of insertion between teeth, touch of each wire with teeth and gum, pain at the time of insertion or use, cleaning effect and overall evaluation. The results are shown in Table 6. The results are expressed as average values and the figures within the parentheses show standard deviations.

[Table 6]

TABLE 6

| Evaluation of actual use of interdental brush using new alloy wire of the present invention, interdental brush using NAS604PH wire and interdental brush using SUS304HN (SUS304N2) wire (11 brushes of each type were used for 1 day) | | | | |
|---|---|---|---|---|
| Evaluation item | Evaluation point | Interdent brush using new alloy wire of the present invention average value (standard deviation) | Interdent brush using NAS604PH wire average value (standard deviation) | Interdent brush using SUS304 wire average value (standard deviation) |
| Resilient force of wire | 2: high<br>1: slightly high<br>0: medium<br>−1: slightly low<br>−1: low | 0.57 (0.87) | 0.19 (1.03) | −0.19 (0.89) |
| like or dislike of resilient force of wire | 2: like<br>1: like a little<br>0: medium<br>−1: dislike a little<br>−2: dislike | 0.43 (0.87) | −0.05 (0.92) | 0.05 (0.80) |
| bending of wire (difficult to use because it is bent) | 2: hard to be bent<br>1: slightly hard to be bent<br>0: medium<br>−1: slight easy to be bent<br>−2: easy to be bent | 0.57 (0.81) | 0.24 (1.09) | 0.00 (0.83) |
| Ability of insertion betweeen teeth | 2: easy to insert<br>1: slightly easy to insert<br>0: medium<br>−1: slightly difficuly to insert<br>−2: difficult to insert | 0.29 (0.90) | 0.10 (0.83) | 0.24 (0.77) |
| Touch with tooth and gum | 2: good<br>1: slightly good<br>0: medium<br>−1: slightly bad<br>−2: bad | 0.05 (0.74) | 0.00 (0.95) | 0.14 (0.65) |
| Pain at the time of insertion or use | 2: feel no pain<br>1: do not feel so much pain<br>0: medium<br>−1: feel a slight pain | 0.19 (1.08) | 0.14 (1.01) | 0.43 (0.75) |

TABLE 6-continued

| Evaluation item | Evaluation point | Interdent brush using new alloy wire of the present invention average value (standard deviation) | Interdent brush using NAS604PH wire average value (standard deviation) | Interdent brush using SUS304 wire average value (standard deviation) |
|---|---|---|---|---|
| | Evaluation of actual use of interdental brush using new alloy wire of the present invention, interdental brush using NAS604PH wire and interdental brush using SUS304HN (SUS304N2) wire (11 brushes of each type were used for 1 day) | | | |
| Cleaning effect | −2: feel a pain<br>2: feel that teeth are well cleaned<br>1: feel that teeth are cleaned<br>0: medium<br>−1: feel that teeth are not so well cleaned<br>−2: feel that teeth are not cleaned | 0.48 (0.81) | 0.38 (0.74) | 0.43 (0.51) |
| Overall evaluation | 1, 2 and 3 are given in the order from the best one | 1.62 (0.74) | 2.14 (0.65) | 1.86 (0.85) |

As is evident from Table 6, the interdental brush of the above example (defined in the seventh aspect of the present invention) is superior to the interdental brush using NAS604PH in all the items and also to the interdental brush using SUS304N2 in all the items except the touch of each wire with teeth and gum and pain at the time of insertion and use. The interdental brush of the above example (defined in the seventh aspect of the present invention) is superior to the interdental brush using SU304N2 which is superior to the interdental brush using NAS604PH in overall evaluation.

The inventor has also conducted the simple evaluation of the actual use of interdental brushes using SUS304N2 (SUS304HN) and SUS304N1 (SUS304ES) of the second group. This evaluation was conducted on 15 users and the evaluation items total 5 consisting of presence or absence of elastic force of each wire, like or dislike of elastic force of each wire, difficulty of bending each wire, durability of each wire and overall evaluation. The respective wires were used every morning and night reciprocally for 1 week. The results are shown in Tables 7 and 8.

TABLE 7

Evaluation results of actual use of interdental brush using SUS304HN (SUS304N2) wire and interdental brush using SUS304 wire.

| Evaluation item | Number of respondents who answer that SUS304HN (SUS304N2) is better | Number of respondents who answer that both are the same | Number of respondents who answer that SUS304 is better |
|---|---|---|---|
| Presence or absence of resilient force of wire | 13 | 2 | 0 |
| Like or dislike of resilient force of wire | 13 | 2 | 0 |
| Difficulty of bending wire | 12 | 3 | 0 |
| Durability of wire | 10 | 5 | 0 |

TABLE 7-continued

Evaluation results of actual use of interdental brush using SUS304HN (SUS304N2) wire and interdental brush using SUS304 wire.

| Evaluation item | Number of respondents who answer that SUS304HN (SUS304N2) is better | Number of respondents who answer that both are the same | Number of respondents who answer that SUS304 is better |
|---|---|---|---|
| Overall evaluation | 14 | 1 | 0 |

TABLE 8

Evaluation results of actual use of interdental brush using SUS304ES (SUS304N1) and interdental brush using SUS304 wire.

| Evaluation item | Number of respondents who answer that SUS304ES (SUS304N1) is better | Number of respondents who answer that both are the same | Number of respondents who answer that SUS304 is better |
|---|---|---|---|
| Presence or absence of resilient force of wire | 10 | 3 | 2 |
| Like or dislike of resilient force of wire | 9 | 4 | 2 |
| Difficulty of bending wire | 11 | 3 | 1 |
| Durability of wire | 7 | 5 | 3 |
| Overall evaluation | 11 | 4 | 0 |

Further, as shown in Table 7, though the interdental brush using SUS304HN could not exhibit such excellent properties as the example of the first group, it was rated higher than the existing interdental brush using SUS304. Also, as shown in Table 8, though the interdental brush using SUS304ES is inferior to the interdental brush using SUS304HN, it was rated higher than the existing interdental brush using SUS304.

The interdental brush wire and the interdental brush according to the present invention are superior to a conventionally known stainless steel wire in mechanical strengths such as Young's modulus, proof stress and tensile strength and can improve hardness, spring properties and workability required for an interdental brush wire in a well-balanced manner as well as durability against buckling or break. Therefore, a springy interdental brush having excellent manipulation ease can be obtained. Since the diameter of the wire can be reduced while retaining characteristic features as the wire stem material of an interdental brush, the ability of insertion between teeth can be improved without strain.

Further, when a small amount of molybdenum is added, the corrosion resistance is improved in addition to the above characteristic features and the toughness is enhanced by changing the metal structure of a wire brush to austenite.

What is claimed is:

1. An interdental brush wire which comprises a stainless steel wire having a diameter of 0.15 to 0.35 mm and containing at least iron, chromium, manganese and nitrogen in the chemical composition, wherein a chromium content is 12 to 32 wt %, a manganese content is 10 to 38 wt % and a nitrogen content is not less than 0.10 wt %.

2. An interdental brush wire which comprises an austenite stainless steel wire having a diameter of 0.15 to 0.35 mm and containing at least iron, chromium, manganese and nitrogen in the chemical composition, wherein a chromium content is 17 to 19 wt %, a manganese content is 17 to 19 wt % and a nitrogen content is not less than 0.65 wt %.

3. An interdental brush wire which comprises a stainless steel wire having a diameter of 0.15 to 0.35 mm and containing at least iron, chromium, manganese, molybdenum, nickel and nitrogen in the chemical composition, wherein a chromium content is 12 to 32 wt %, a manganese content is 10 to 38 wt %, a nickel content is not more than 6 wt %, a molybdenum content is not more than 7 wt % and a nitrogen content is not less than 0.10 wt %.

4. An interdental brush wire which comprises an austenite stainless steel wire having a diameter of 0.15 to 0.35 mm and containing at least iron, chromium, manganese, molybdenum, nickel and nitrogen in the chemical composition, wherein a chromium content is 17 to 19 wt %, a manganese content is 17 to 19 wt %, a nickel content is less than 1.0 wt %, a molybdenum content is 1.5 to 2.5 wt % and a nitrogen content is not less than 0.65 wt %.

5. An interdental brush wire which comprises an austenite stainless steel wire having a diameter of 0.15 to 0.35 mm and containing at least carbon in an amount of not more than 0.08 wt %, silicon in an amount of not more than 1.00 wt %, manganese in an amount of 17.00 to 19.00 wt %, phosphorus in an amount of not more than 0.045 wt %, sulfur in an amount of not more than 0.030 wt %, nickel in an amount of not more than 1.0 wt %, chromium in an amount of 17.00 to 19.00 wt %, molybdenum in an amount of 1.5 to 2.5 wt % and nitrogen in an amount of not less than 0.65 wt % in the chemical composition.

6. An interdental brush wire which comprises an austenite stainless steel wire having a diameter of 0.15 to 0.35 mm and containing at least carbon in an amount of not more than 0.08 wt %, silicon in an amount of not more than 1.00 wt %, manganese in an amount of not more than 2.50 wt %, phosphorus in an amount of not more than 0.045 wt %, sulfur in an amount of not more than 0.030 wt %, nickel in an amount of 7.00 to 10.50 wt %, chromium in an amount of 18.00 to 20.00 wt % and nitrogen in an amount of 0.10 to 0.25 wt % in the chemical composition.

7. An interdental brush wire which comprises: a wire having a diameter of 0.15 to 0.35 mm; and a material defined in SUS304N1 steel wire made from a JIS G4303 stainless steel bar.

8. An interdental brush wire which comprises an austenite stainless steel wire having a diameter of 0.15 to 0.35 mm and containing at least carbon in an amount of not more than 0.08 wt %, silicon in an amount of not more than 1.00 wt %, manganese in an amount of not more than 2.50 wt %, phosphorus in an amount of not more than 0.045 wt %, sulfur in an amount of not more than 0.030 wt %, nickel in an amount of 7.50 to 10.50 wt %, chromium in an amount of 18.00 to 20.00 wt %, nitrogen in an amount of 0.15 to 0.30 wt % and niobium in an amount of not more than 0.15 wt % in the chemical composition.

9. An interdental brush wire which comprises: a wire having a diameter of 0.15 to 0.35 mm; and a material defined in SUS304N2 steel wire made from a JIS G4303 stainless steel bar.

10. An interdental brush wire as claimed in any one of claims 1 to 9, having such wire tensile properties as a proof stress of not less than 40 kgf/mm$^2$ and an elongation of not less than 30% before twisting.

11. An interdental brush wire as claimed in any one of claims 1 to 10, having such wire tensile properties as a Young's modulus of not less than 12,000 kgf/mm$^2$ before twisting.

12. An interdental brush prepared by twisting the interdental brush wire as claimed in any one of claims 1 to 11, sandwiching and fixing bundles of filaments between the twisted wires and using the wire as a core material of the brush.

* * * * *